US009218766B2

(12) United States Patent
Wu et al.

(10) Patent No.: US 9,218,766 B2
(45) Date of Patent: Dec. 22, 2015

(54) PIXEL UNIT CIRCUIT, PIXEL ARRAY, DISPLAY PANEL AND DISPLAY PANEL DRIVING METHOD

(75) Inventors: Zhongyuan Wu, Beijing (CN); Liye Duan, Beijing (CN); Guangcai Yuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 594 days.

(21) Appl. No.: 13/469,165

(22) Filed: May 11, 2012

(65) Prior Publication Data

US 2012/0287103 A1 Nov. 15, 2012

(30) Foreign Application Priority Data

May 13, 2011 (CN) ..... 2011 1 0124714

(51) Int. Cl.
*G09G 3/30* (2006.01)
*G09G 3/32* (2006.01)

(52) U.S. Cl.
CPC ..... *G09G 3/3233* (2013.01); *G09G 2300/0842* (2013.01); *G09G 2300/0866* (2013.01); *G09G 2320/045* (2013.01)

(58) Field of Classification Search
CPC .. G09G 3/3233; G09G 3/2022; G09G 3/3241
USPC ..... 345/78, 92, 211; 315/169.3
See application file for complete search history.

(56) References Cited

U.S. PATENT DOCUMENTS 7,173,590 B2 * 2/2007 Uchino et al. ..... 345/92
7,307,463 B2 * 12/2007 Miyake et al. ..... 327/437
7,502,000 B2 * 3/2009 Yuki et al. ..... 345/77
8,004,207 B2 * 8/2011 Elder ..... 315/291
8,059,116 B2 * 11/2011 Ishizuka ..... 345/213
2004/0239661 A1 12/2004 Jo
2009/0284511 A1 * 11/2009 Takasugi et al. ..... 345/211

FOREIGN PATENT DOCUMENTS

CN 1534572 A 10/2004
JP 2003-330418 A 11/2003
JP 2004-302211 A 10/2004
JP 2005-258427 A 9/2005

OTHER PUBLICATIONS

First Chinese Office Action dated Dec. 3, 2013; Appln. No. 201110124714.X.
Korean Intellectual Property Office Notice of Allowance dated Feb. 27, 2014; Appln. 10-2012-0050404.
Extended European Search Report dated Sep. 10, 2012; Appln. 12167672.0-1228.
European Patent Office Action dated Dec. 16, 2014; Appln. No. 12 161 178.4-1508.
European Patent Office Action dated Dec. 17, 2014; Appln. No. 12 167 672.0-1903.

* cited by examiner

*Primary Examiner* — Priyank Shah
*Assistant Examiner* — Calvin C Ma
(74) *Attorney, Agent, or Firm* — Ladas & Parry LLP

(57) ABSTRACT

A pixel circuit array is disclosed and includes pixel unit circuits, and each of the pixel unit circuit includes a precharge circuit, a compensation circuit, a holding circuit, a driving circuit, a light emitting circuit, a first power supply terminal, a second power supply terminal, a third power supply terminal, a scanning control terminal, a first control terminal and a second control terminal. With the pixel unit circuit, as long as the inputted direct-current reference voltage and the data voltage signal are not varied, the current delivered to the OLED remains constant, thus the uniformity of the OLED can be compensated for.

12 Claims, 4 Drawing Sheets

PIXEL UNIT CIRCUIT, PIXEL ARRAY, DISPLAY PANEL AND DISPLAY PANEL DRIVING METHOD

CROSS REFERENCE TO RELATED APPLICATIONS

This application claims the benefit to Chinese Application No. 201110124714.X, filed May 13, 2011, the entire disclosure of which is incorporated herein by reference.

BACKGROUND

Embodiments of the disclosed technology relate to a pixel unit circuit, a pixel array, a display panel and display panel driving method.

As a light emitting device of current type, an organic light emitting diode (OLED) has been increasingly used in high-performance display apparatuses. A traditional passive matrix organic light emitting display (PMOLED) requires less driving time for a single pixel as the size of the display is gradually increased, thus it is necessary to increase transient current and increase power consumption. Meanwhile, application of a large current may cause the voltage drop on the ITO (indium tin oxide) line to an extremely large level and make the operation voltage for the OLED extremely high, and thereby the efficiency thereof is reduced. By contrast, an active matrix organic light emitting display (AMOLED) can input current for each pixel in a line by line scan manner with a switching element, and can solve these problems.

During the operation of the AMOLED pixel circuit, due to the uniformity of the threshold voltage of the TFTs as switching elements, the uniformity of the OLED itself or resistance voltage drop (IR Drop, a phenomenon in which, in a rear board, the voltage of a region that is close to the ARVDD power supply position is higher than that of a region that is far away from the power supply position) etc, circuit instability and unevenness of the OLED luminance may be incurred, thereby the pixel circuit array as a whole is affected. Therefore, the circuit being driven by the OLED needs to be improved in related arts, so that compensation is performed on the pixels with the OLED driving circuit.

According to driving type, the AMOLED can be divided into three categories, i.e., digital type, current type and voltage type. Similar to the traditional AMOLED driving method, the driving method of the voltage type is a method in which a voltage signal representing a gray scale is provided by an integrated driving chip, and the voltage signal will be converted to a current signal inside the pixel circuit so as to drive the OLED pixel. This method is advantageous in that the driving speed is fast and the implementation is easy, is suitable to driving display panels of a large size, and has been widely employed in industries.

FIG. 1 shows a first kind of driving circuit of the voltage type for driving the OLED in related arts. In each pixel, a voltage signal on the data line is transmitted by the T2 to the gate of the T1, and the received data voltage signal is converted by the T1 into a corresponding data current signal and supplied to the OLED. When normally operated, the T1 is in a saturation condition, and the current thereof can be represented as:

$$I_{OLED} = \frac{1}{2}\mu_P \cdot Cox \cdot \frac{W}{L} \cdot (Vdata - ARVDD - Vthp)^2 \quad (1)$$

where $\mu_p$ represents a mobility of carries, $C_{ox}$ represents a gate oxide capacitance, W/L represents a ratio of width to length of a TFT channel, Vdata represents a data voltage, ARVDD represents a power supply of the rear board of the AMOLED and is shared by all of the pixel unit circuits, and Vthp represents the threshold voltage of the T1. As can be known from the above expression, if the Vthp of the driving TFT (T1 in FIG. 1) in different pixel unit circuits are different, there exists a difference in the currents delivered to the respective OLEDs even if the data voltages to be delivered are of the same; meanwhile, if the ARVDD practically applied to the respective pixels are different, there also exists a difference in the currents delivered to the OLEDs.

FIG. 2A is a schematic diagram showing a second kind of the driving circuit of the voltage type for driving the OLED in related arts, and FIG. 2B shows a timing control diagram for the driving circuit of the voltage type. In this circuit, the voltage applied to the gate of the T2 is a voltage of $V_{DATA}$+Vthp, which is independent of the power supply voltage VDD, thus this circuit can compensate for the IR Drop, but can not compensate for the uniformity of the TFTs.

FIG. 3A is a schematic diagram showing a third kind of the driving circuit of the voltage type for driving the OLED in related arts, and FIG. 3B shows a timing control diagram for the driving circuit of the voltage type. In this circuit structure, the voltage practically applied to the gate of the transistor T1 is independent of the threshold voltage Vth of the T1 and the power supply voltage ELVDD, and the threshold voltage uniformity of the driving transistor T1 and the IR Drop can be compensated for. However, this circuit requires four TFTs and two capacitors, and the voltage practically applied to the gate of the transistor T1 is associated with a ratio of the two capacitors; whereas the magnitudes of the two capacitors in this circuit differ not much, and a dynamic range of the inputted voltage is relatively small.

FIG. 4A is a schematic diagram showing a fourth kind of the driving circuit of the voltage type for driving the OLED in related arts, and FIG. 4B shows a timing control diagram for the driving circuit of the voltage type. In this circuit, the current inputted to the OLED remains constant, and the uniformity of the OLED can be compensated for; however, the voltage applied to the gate of the transistor T1 is associated with both of the threshold voltage Vth of the T1 and the power supply voltage ELVDD, and the threshold voltage uniformity of the driving transistor T1 and the IR Drop can not be compensated for.

SUMMARY

One embodiment according to the disclosed technology provides a pixel circuit array comprising: scanning lines; data lines; and pixel unit circuits defined by the scanning lines and the data lines intersected with each other. Each of the pixel unit circuits comprise a light emitting circuit for emitting light, a driving circuit for driving the light emitting circuit, a precharge circuit for normally operating the driving circuit, a compensation circuit for compensating for the threshold voltage of the driving circuit, a holding circuit for holding voltages of a control terminal and an input terminal of the driving circuit, a first power supply terminal for supplying voltage to the precharge circuit, a second power supply terminal for supplying voltage to the driving circuit, a third power supply terminal for supplying voltage to the light emitting circuit, a scanning control terminal for controlling the precharge circuit to be operated or switched off, a first control terminal for controlling the holding circuit to be operated or switched off; and a second control terminal for controlling the compensation circuit to be operated or switched off; wherein the input terminal of the precharge circuit is connected to the first power supply terminal, a first output terminal thereof is connected to the input terminal of the holding circuit, the second output terminal thereof is connected to the input terminal of the compensation circuit and the control terminal of the driving circuit, and the control terminal thereof is connected to the scanning control terminal; the output terminal of the compensation circuit is connected to the output terminal of the driving circuit and the input terminal of the light emitting circuit, and the control terminal thereof is connected to the second control terminal; wherein the output terminal of the holding circuit is connected to the input terminal of the driving circuit and the second power supply terminal, and the control terminal thereof is connected to the first control terminal.

Another embodiment according to the disclosed technology provides an OLED panel comprising the pixel circuit array as described above.

A further embodiment according to the disclosed technology provides an OLED panel driving method used for the above OLED panel, wherein, of the pixel driving circuit therein, the precharge circuit includes a fourth transistor and a first capacitor; the compensation circuit includes a second transistor; the holding circuit includes a third transistor; the driving circuit includes a first transistor; and the light emitting circuit includes an organic light emitting diode (OLED), the method comprising steps of: outputting, by the scanning line, an active signal through the scanning control terminal so as to turn on the fourth transistor, and outputting an inactive signal by the first control terminal and the second control terminal so as to turn off the second transistor and the third transistor; inputting the active signal to the gate of the first transistor so as to turn on the first transistor; and transmitting a first level signal outputted from the second power supply terminal to the anode of the OLED through the first transistor.

DETAILED DESCRIPTION

An OLED panel according to an embodiment of the disclosed technology includes a first power supply terminal, a second power supply terminal, a third power supply terminal and a pixel circuit array. The pixel circuit array comprises a plurality of pixel unit circuits, and the pixel circuit array further includes scanning lines and data lines. Each of the pixel unit circuits includes a first transistor, a second transistor, a third transistor, a fourth transistor, a first capacitor and an organic light emitting diode (OLED). The gate of the first transistor is connected to one terminal of the first capacitor and the source of the second transistor. The source of the first transistor is connected to the drain of the third transistor and the second power supply terminal. The drain of the first transistor is connected to the drain of the second transistor and the anode of the OLED. The source of the third transistor is connected to another terminal of the first capacitor and the drain of the fourth transistor. The gate of the fourth transistor is connected to the scanning line. The source of the fourth transistor is connected to the first power supply terminal. The adoption of the pixel unit circuits provided by the embodiment of the disclosed technology allows a current delivered to the OLED to be independent of the threshold voltage of TFTs and the power supply voltage, thus the uniformity of the threshold voltages of TFTs, the uniformity of the OLEDs and the IR Drop can be compensated for. Furthermore, the number of devices employed by disclosed technology is relative small, thus the aperture ratio can be effectively improved.

Figure 1:
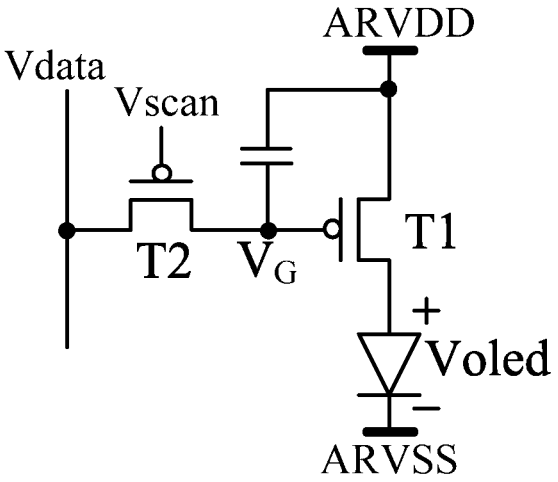
FIG.1 (PRIOR ART)
FIG. 1 shows a first kind of a driving circuit of a voltage type for driving an OLED in related arts.
Figure 2A:
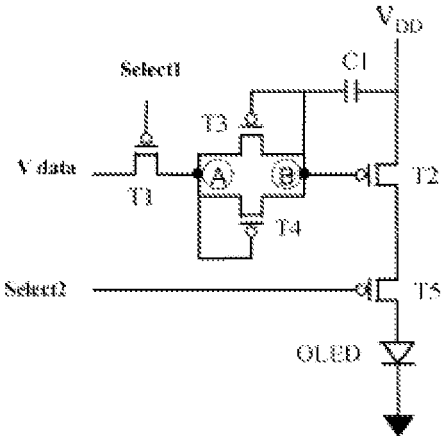
FIG.2A (PRIOR ART)
FIG. 2A is a schematic diagram showing a second kind of the driving circuit of the voltage type for driving the OLED in related arts.
Figure 2B:
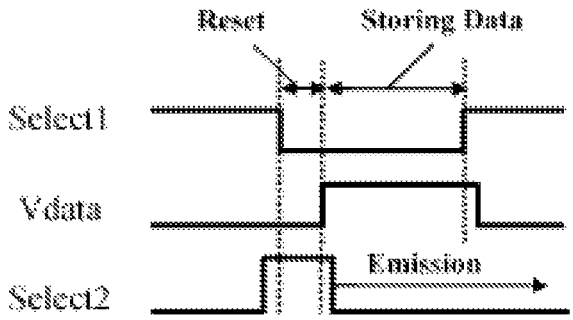
FIG.2B (PRIOR ART)
FIG. 2B shows a timing control diagram for the driving circuit of the voltage type.
Figure 3A:
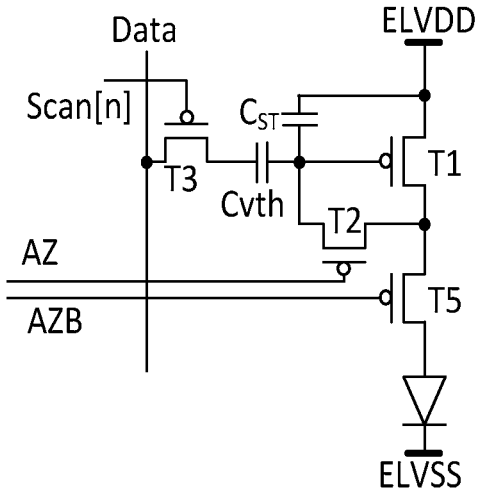
FIG.3A (PRIOR ART)
FIG. 3A is a schematic diagram showing a third kind of the driving circuit of the voltage type for driving the OLED in related arts.
Figure 3B:
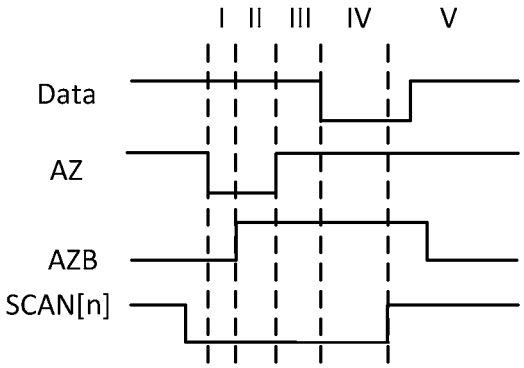
FIG.3B (PRIOR ART)
FIG. 3B shows a timing control diagram for the driving circuit of the voltage type.
Figure 4A:
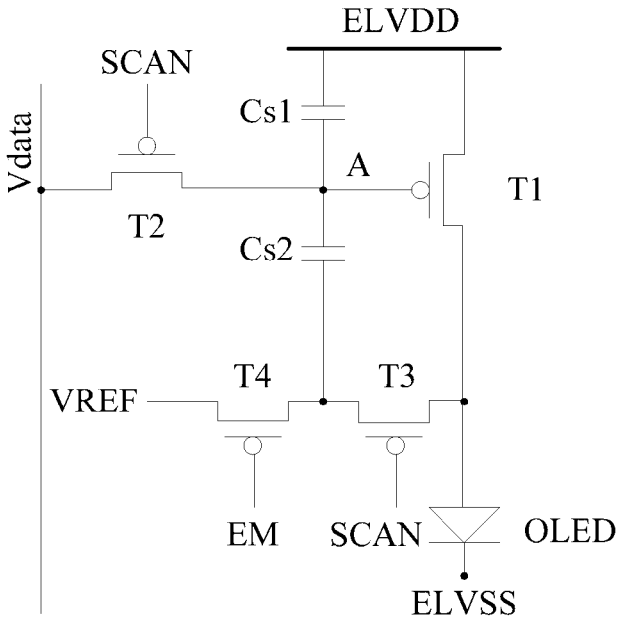
FIG.4A (PRIOR ART)
FIG. 4A is a schematic diagram showing a fourth kind of the driving circuit of the voltage type for driving the OLED in related arts.
Figure 4B:
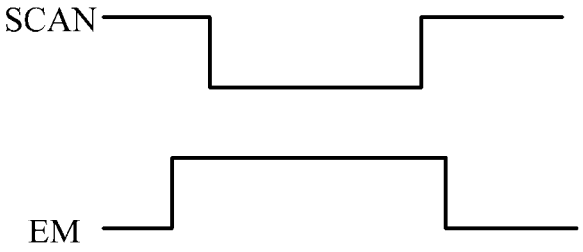
FIG.4B (PRIOR ART)
FIG. 4B shows a timing control diagram for the driving circuit of the voltage type.
Figure 5:
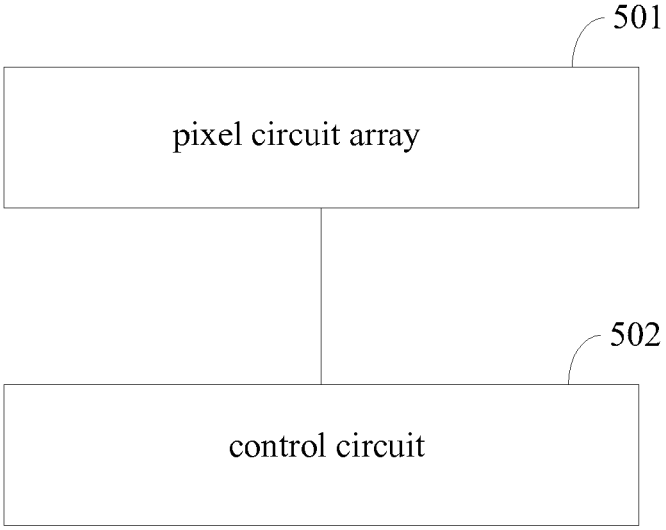
FIG. 5 is a diagram showing a main structure of an OLED panel according to an embodiment of the disclosed technology.

With reference to FIG. 5, the display panel according to the embodiment of the disclosed technology includes a pixel circuit array 501. The OLED panel further includes a control circuit 502 for supplying a control signal to the pixel circuit array 501.

In addition to scanning lines, data lines and pixel unit circuits, the pixel circuit array 501 comprises pixel unit circuits defined by the scanning lines and the data lines intersected with each other.

Figure 6A:
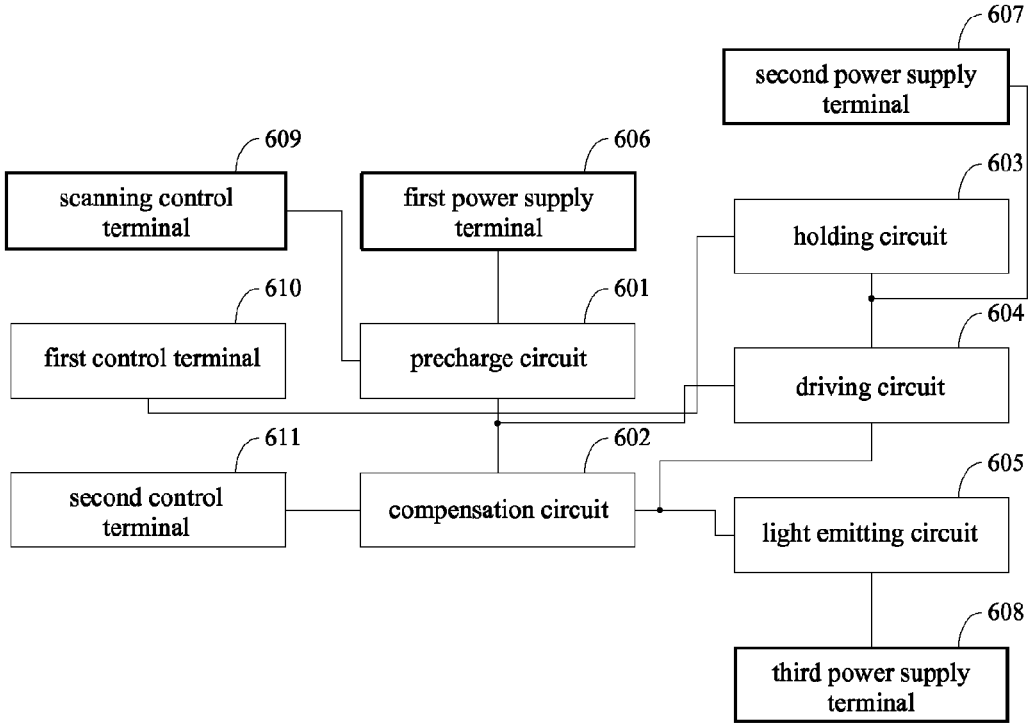
FIG. 6A is a diagram showing a main structure of a pixel unit circuit according to an embodiment of the disclosed technology.

With reference to FIG. 6A, the pixel unit circuit according to the embodiment of the disclosed technology comprises a light emitting circuit 605 for emitting light, a driving circuit 604 for driving the light emitting circuit 605; a precharge circuit 601 for normally operating the driving circuit 604; a compensation circuit 602 for compensating for the threshold voltage of the driving circuit 604; a holding circuit 603 for holding voltages of a control terminal and an input terminal of the driving circuit; a first power supply terminal 606 for supplying a voltage to the precharge circuit 601; a second power supply terminal 607 for supplying a voltage to the driving circuit 604; a third power supply terminal 608 for supplying a voltage to the light emitting circuit 605; a scanning control terminal 609 for controlling the precharge circuit 601 to be operated or switched off; a first control terminal 610 for controlling the holding circuit 603 to be operated or switched off; and a second control terminal 611 for controlling the compensation circuit 602 to be operated or switched off. Of the precharge circuit 601, an input terminal is connected to the first power supply terminal 606, a first output terminal is connected to the input terminal of the holding circuit 603, a second output terminal is connected to the input terminal of the compensation circuit 602 and the control terminal of the driving circuit 604, and a control terminal is connected to the scanning control terminal 609. Of the compensation circuit 602, an output terminal is connected to an output terminal of the driving circuit 604 and an input terminal of the light emitting circuit 605, and a control terminal is connected to the second control terminal 611. Of the holding circuit 603, an output terminal is connected to an input terminal of the driving circuit 604 and the second power supply terminal 607, and a control terminal is connected to the first control terminal 610. An output terminal of the light emitting circuit 605 is connected to the third power supply terminal 608. Each of the first control terminal 610 and the second control terminal 611 is connected to the control circuit 502, and different control signals are outputted by the control circuit 502 through the first control terminal 610 and the second control terminal 611. The scanning control terminal 609 is connected to the scanning lines of the pixel circuit array, and control signals are provided to the precharge circuit 601 by the scanning lines through the scanning control terminal 609. The first power supply terminal 606 is connected to the data lines of the pixel circuit array 501. The second power supply terminal 607 and the third power supply terminal 608 are connected to different power supply voltage terminals respectively.

The first power supply terminal 606, the second power supply terminal 607 and the third power supply terminal 608 are connected to different power supply voltage terminals respectively for supplying the power supply voltages to the pixel circuit array 501.

With reference to 6B, the precharge circuit 601 includes a fourth transistor (simply referred to as T4 hereinafter) and a first capacitor (simply referred to as C1 hereinafter), and the first output terminal of the precharge circuit 601 is the node N1 of FIG. 6B, and the second output terminal thereof is the node N2 of FIG. 6B. The compensation circuit 602 comprises a second transistor (simply referred to as T2 hereinafter). The holding circuit 603 comprises a third transistor (simply referred to as T3 hereinafter). The driving circuit 604 comprises a first transistor (simply referred to as T1 hereinafter). The light emitting circuit 605 comprises an OLED. The input terminal of the precharge circuit 601 refers to the source terminal of the T4, and the output terminal of the precharge circuit 601 refers to the drain terminal of the T4. The input terminal of the compensation circuit 602 refers to the source terminal of the T2; the output terminal of the circuit 602 refers to the drain terminal of the T2. The input terminal of the holding circuit 603 refers to the source terminal of the T3, and the output terminal of the circuit 603 refers to the drain terminal of the T3. The input terminal of the driving circuit 604 refers to the source terminal of the T1, and the output terminal of the circuit 604 refers to the drain terminal of the T1. The input terminal of the light emitting circuit 605 refers to the anode terminal of the light emitting diode T5. If the T4 is turned on, then the precharge circuit 601 is operated, while the T4 is turned off, and then the precharge circuit 601 is switched off. If the T3 is turned on, then the holding circuit 603 is operated, while the T3 is turned off, and then the holding circuit 603 is switched off. If the T2 is turned on, then the compensation circuit 602 is operated, while the T2 is turned off, and then the compensation circuit 602 is switched off.

Figure 6B:
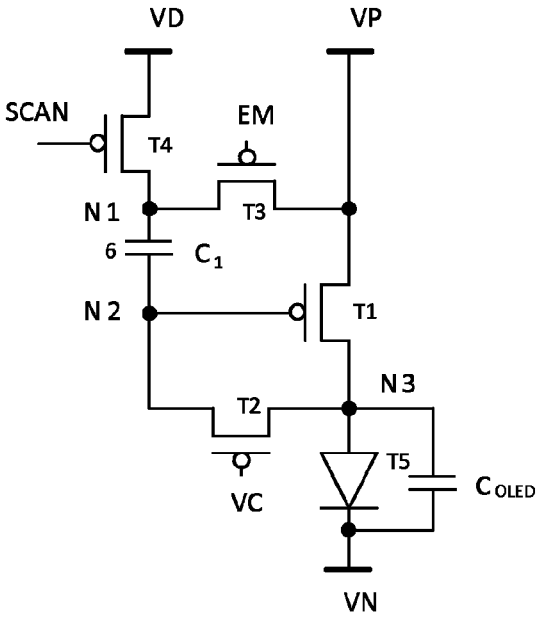
FIG. 6B a diagram showing a detailed structure of the pixel unit circuit according to an embodiment of the disclosed technology.

The gate of the T1 is connected to one terminal of the C1 and the source of the T2; the source of the T1 is connected to the drain of the T3 and the second power supply terminal 607, and the output terminal of the second power supply terminal 607 is the VP terminal of FIG. 6B. The drain of the T1 is connected to the drain of the T2 and the anode of the OLED. The source of the T3 is connected to another terminal of the C1 and the drain of the T4, and the gate of the T3 is connected to the first control terminal 610. The gate of the T4 is connected to the scanning control terminal 609, the source of the T4 is connected to the first power supply terminal 606, and the output terminal of the first power supply terminal 606 is the VD terminal of FIG. 6B. The gate of the T2 is connected to the second control terminal 611 which is the VC terminal of FIG. 6B; the second control terminal 611 provides a second control signal for the T2. The gate of the T3 is connected to the first control terminal 610 which is the EM terminal of FIG. 6B; the first control terminal 610 provides a first control signal for the T3. In the circuit, the OLED can be equivalent to a light emitting diode T5 and a capacitor $C_{OLED}$ connected in parallel; the anode of the OLED is the anode of the light emitting diode T5, which is the node N3 of FIG. 6B, i.e., the input terminal of the light emitting circuit 608; the output terminal of the light emitting circuit 608 is the cathode terminal of the light emitting diode T5. The cathode terminal of the light emitting diode T5 is connected to the third power supply terminal 608. The first control signal and the second control signal are both provided by the control circuit 502 on the OLED panel; the control circuit 502 is used to control the first control signal and the second control signal, that is, the control circuit 502 controls the gate voltages of the T2 and the T3 through the second control terminal 611 and the first control terminal 610 respectively.

Each of the first transistor, the second transistor, the third transistor and the fourth transistor in the embodiment of the disclosed technology can be a TFT; in an example, all of the TFTs in the embodiment of the disclosed technology are P-type TFTs. Those skilled in the art can also make modifications or alternation to the embodiment of the disclosed technology. For example, the TFTs of the embodiments of the disclosed technology can be replaced with N-type TFTs, in which case the circuit structure and the control signal timings will be altered correspondingly; and since the operation principle thereof is similar to that of the pixel circuit constituted by the P-type TFTs, those skilled in the art will know how to realize the another embodiment of the disclosed technology with the N-type TFTs under the teachings of the embodiment of the disclosed technology.

In the embodiment of the disclosed technology, the driving of the OLED can be divided into three periods of an initialization period, a compensation period and a holding period.

Initialization Period

The first power supply terminal 606 (VD) and the second power supply terminal 607 (VP) output a low power supply level (ARVSS), while the third power supply terminal 608 outputs a high power supply level (ARVDD). The OLED can be equivalent to a light emitting diode T5 and a second capacitor (simply referred to as $C_{OLED}$ hereinafter) that are connected in parallel in terms of electrics performance, thus the OLED is reversely turned off. The voltage stored in the node N1 of FIG. 6 at the previous one period is ARVDD, and the voltage stored in the node N2 at the previous one period is ARVDD$-V_{DATA}$(n−1)+VREF+Vthp, and then it can be learned that the voltage drop on the C1 is $-V_{DATA}$(n−1)+VREF+Vthp, where $V_{DATA}$(n−1) is the data voltage inputted in the previous one frame, VREF is a direct-current reference voltage, and Vthp is the threshold voltage of the T1 (Vthp<0). At this moment, the scanning line outputs the low power supply level (VGL), and controls the EM and the VC to be the high power supply level (VGH). The T1 and the T4 are turned on, and the T2 and the T3 are turned off, thus the low power supply level ARVSS are transferred to the node N1 via the T4; due to bootstrap effect by the C1, the voltage of the node N2 is changed to ARVSS$-V_{DATA}$(n−1)+VREF+Vthp, i.e., a voltage obtained by subtracting the voltage drop on the C1 from the voltage of the node N1. In the embodiment of the disclosed technology, with the VREF being suitably selected so that $-V_{DATA}$(n−1)+VREF<0, i.e., the voltage at node N2 is a low level, the T1 is turned on, and the voltage of the node N3 is also equal to ARVSS.

Thereafter, the output voltage of the VD terminal is changed from the ARVSS to the data voltages $V_{DATA}$(n) of the current frame, the VP remains at the low power supply level (ARVSS), and the VN remains at the high power supply level (ARVDD). At this moment, the voltage of the node N2 is changed to $V_{DATA}(n)-V_{DATA}(n-1)+VREF+Vthp$, i.e., a voltage obtained by subtracting the voltage drop on the C1 from the voltage of the node N1. The voltage of the node N3 remains at the ARVSS. The VC is controlled to be the low power supply level (VGL), and the T2 is turned on; the C1 is serially connected to the capacitor $C_{OLED}$ of the equivalent circuit of the OLED. From the principle of charge conservation, the final voltages of the N2 (which is also referred to as node $V_{INIT}$ after the T2 is turned on) and the N3 can be obtained as:

$$[-V_{DATA}(n-1)+VREF+Vthp]\cdot C_6+(ARVSS-ARVDD)\cdot C_{OLED}=V_{INIT}\cdot(C_6+C_{OLED}) \quad (1).$$

Thus, $$V_{INIT}=\frac{[-V_{DATA}(n-1)+VREF+Vthp]\cdot C_6+(ARVSS-ARVDD)\cdot C_{OLED}}{C_6+C_{OLED}}. \quad (2)$$

Since ARVSS−ARVDD<0 and $C_{OLED}$>>C6 generally, $$V_{INIT}\approx ARVSS-ARVDD \quad (3),$$

and the nodes of N2 and N3 are identical in voltage, which is $V_{INIT}$. That is, at this period, a precharge to the voltages of the nodes N2 and N3 are completed.

Compensation Period

Where the data voltage $V_{DATA}(n)$ of the current frame is outputted at the VD terminal, the direct-current reference voltage (VREF) is outputted at the VP terminal, and the high power supply level signal (ARVDD) is outputted at the VN terminal, the OLED remains reversely turned off. The scanning line (SCAN terminal) and the VC are controlled to be the low power supply level (VGL), and the EM is controlled to be the high power supply level (VGH); at this period, since VREF is higher than zero, and the initialization voltage $V_{INIT}$ of the nodes N2 and N3 is lower than zero, the T1 which is turned now is equivalent to a diode at this moment, and the current is flowed from the VREF to the node N3 to charge the node N3; after the voltage of node N3 is increased to a voltage of VREF+Vthp (which is a voltage obtained by adding the VREF to the threshold voltage of the T1), the T1 is turned off. When the compensation period comes to an end, the charge stored on both terminals of the C1 is $(VREF+Vthp-V_{DATA}(n))\cdot C6$; since the T4 is operated in the linear region, the threshold voltage is not consumed.

Holding Period

Where the high power supply level (ARVDD) is outputted at the VD terminal and the low power supply level (ARVSS) is outputted at the VN terminal, the OLED is forwardly turned on. The SCAN and the VC is controlled to be the high power supply level (VGH) and the EM is controlled to be the low power supply level (VGL), then the T1 and the T3 are turned on, and the T2 and the T4 are turned off; C1 is connected between the gate and the source of the T1 for holding the $V_{GS}$ (that is, gate-source voltage) of the T1, and the charge stored therein remains unchanged. The node N1 is connected to the ARVDD through the T3, and due to bootstrap effect of the C1, the voltage of the node N2 is changed to $ARVDD-V_{DATA}(n)+VREF+Vthp$, i.e., a voltage obtained by subtracting the voltage drop on the C1 from the voltage of the node N1. The $V_{GS}$ of the T1 remains $VREF+Vthp-V_{DATA}(n)$ (that is, subtracting the voltage of the node N2 from the ARVDD). At this moment, the current flowed through the T1 is represented as:

$$I_{OLED}=\frac{1}{2}\cdot\mu_p\cdot Cox\cdot\frac{W}{L}\cdot[VREF+Vthp-V_{DATA}(n)-Vthp]^2; \quad (4)$$

thus $$I_{OLED}=\frac{1}{2}\cdot\mu_p\cdot Cox\cdot\frac{W}{L}\cdot[VREF-V_{DATA}(n)]^2. \quad (5)$$

As can be learned from the equation (5), the current flowed to the T1 is independent of the threshold voltage of the T1 and the power supply voltage ARVDD; thus with the above three periods, the compensation for the uniformity of the threshold voltage of the T1 and the IR Drop is substantially realized. As long as the inputted direct-current reference voltage VREF and the date voltage $V_{DATA}(n)$ are constant, the current flowed through the T1 is constant, and the uniformity of the OLED can be effectively compensated for.

Hereinafter, an OLED panel driving method according to an embodiment of the disclosed technology will be explained in details in the following. The method comprises steps as follows.

At step 701, an active signal is outputted from the scanning control terminal 609 so as to turn on the fourth transistor, and inactive signals are outputted from the first control terminal 610 and the second control terminal 611 so as to turn off the second transistor and the third transistor. The embodiment of the disclosed technology will be illustrated in connection with FIG. 6B.

At step 702, the active signal is outputted to the gate of the first transistor so that the first transistor is turned on.

At step 703, the first level signal outputted from the second power supply terminal 607 is transmitted to the anode of the OLED through the first transistor.

Both the first power supply terminal 606 and the second power supply terminal 607 output the first level signal, the scanning line outputs the active signal by the scanning control terminal 609, and the third power supply terminal 608 outputs the second level signal. In the embodiment of the disclosed technology, the first level signal may be the low power supply level signal (ARVSS), the second level signal may be the high power supply level signal (ARVDD), and the active signal may be the low level signal. The first control signal and the second control signal are made to be the inactive signal at the same time. The anode of the OLED in the pixel unit circuit is the node N3 of FIG. 6B.

Thereafter, the output voltage of the first power supply terminal 606 is changed to the data voltage of the current frame, and the active signal is outputted from the control circuit 502 through the second control terminal 611, so that the second transistor is turned on, and the voltages of the drain and the gate of the first transistor are of the same and equal to the output voltage of the second power supply terminal 607. In the embodiment of the disclosed technology, the active signal can be the low level signal. The second control terminal 611 is connected to the gate of the second transistor, and the control circuit 502 outputs the active signal to the gate of the second transistor through the second control terminal 611, thus the second transistor is turned on. The second power supply terminal 607 outputs the direct-current reference voltage.

The second power supply terminal 607 outputs the second level signal, and the third power supply terminal 608 outputs the first level signal. The active signal is outputted to the gate of the first transistor so that the first transistor is turned on, and the active signal is outputted from the first control terminal 610 so that the third transistor is turned on. The inactive signal is outputted from the second control terminal 611 and the scanning control terminal 609, so that the second transistor and the fourth transistor are turned off and the data current is delivered to the OLED through the drain of the first transistor.

An OLED panel according to an embodiment of the disclosed technology includes the first power supply terminal 606, the second power supply terminal 607, the third power supply terminal 608 and the pixel circuit array 501. The pixel circuit array 501 comprises the pixel unit circuits and further scanning lines. The pixel unit circuit each includes the first transistor, the second transistor, the third transistor, the fourth transistor, the first capacitor and the OLED. The gate of the first transistor is connected to one terminal of the first capacitor and the source of the second transistor. The source of the first transistor is connected to the drain of the third transistor and the second power supply terminal. The drain of the first transistor is connected to the drain of the second transistor and the anode of the OLED. The source of the third transistor is connected to another terminal of the first capacitor and the drain of the fourth transistor. The gate of the fourth transistor is connected to the scanning control terminal, and the source thereof is connected to the first power supply terminal 606.

With the pixel unit circuit provided by the embodiment of the disclosed technology, as long as the inputted direct-current reference voltage and the data voltage signal are not varied, the current delivered to the OLED remains constant, thus the uniformity of the OLED can be compensated for. Furthermore, the current delivered to the OLED is independent of the threshold voltage of the TFTs and the power supply voltage of the OLED panel, thus the uniformity of the threshold voltage of TFTs and the IR Drop can be compensated for. The control method is simple and easy to realize. The structure of the pixel unit circuit according to the embodiment of the disclosed technology is simple, and the required devices are of a small number, thus the aperture ratio can be effectively improved.

Apparently, those skilled in the art can make various alternations and modifications to the embodiments of the disclosed technology without departing from the spirit and scope of the disclosed technology. Thus, provided that the alternations and modifications to the disclosed technology are within the scope of the claims of the disclosed technology and the equivalents thereof, the disclosed technology is also intended to be inclusive of such alternations and modifications.

What is claimed is:

1. A pixel circuit array comprising:

scanning lines;

data lines; and pixel unit circuits defined by the scanning lines and the data lines intersected with each other, each of the pixel unit circuits comprising:

a light emitting circuit for emitting light;

a driving circuit for driving the light emitting circuit;

a precharge circuit for normally operating the driving circuit;

a compensation circuit for compensating for the threshold voltage of the driving circuit;

a holding circuit for holding voltages of a control terminal and an input terminal of the driving circuit;

a first power supply terminal for supplying voltage to the precharge circuit;

a second power supply terminal for supplying voltage to the driving circuit;

a third power supply terminal for supplying voltage to the light emitting circuit;

a scanning control terminal for controlling the precharge circuit to be operated or switched off;

a first control terminal for controlling the holding circuit to be operated or switched off; and a second control terminal for controlling the compensation circuit to be operated or switched off, wherein the input terminal of the precharge circuit is connected to the first power supply terminal, a first output terminal thereof is connected to the input terminal of the holding circuit, the second output terminal thereof is connected to the input terminal of the compensation circuit and the control terminal of the driving circuit, and the control terminal thereof is connected to the scanning control terminal, wherein the output terminal of the compensation circuit is connected to the output terminal of the driving circuit and the input terminal of the light emitting circuit, and the control terminal thereof is connected to the second control terminal, wherein the output terminal of the holding circuit is connected to the input terminal of the driving circuit and the second power supply terminal, and the control terminal thereof is connected to the first control terminal, wherein the precharge circuit comprises a fourth transistor and a first capacitor, the compensation circuit comprises a second transistor, the holding circuit comprises a third transistor, the driving circuit comprises a first transistor, the light emitting circuit comprises an organic light emitting diode (OLED), and wherein, when the scanning control terminal outputs an active signal: the fourth transistor is turned on, the first control terminal and the second control terminal outputs an inactive signal, the second transistor and the third transistor are turned off, an active signal is input to the gate of the first transistor, the first transistor is turned on, and a first level signal outputted from the second power supply terminal is transmitted to the anode of the OLED through the first transistor.

2. The pixel circuit array according to claim 1, wherein the gate of the first transistor is connected to one terminal of the first capacitor and the source of the second transistor, the source of the first transistor is connected to the drain of the third transistor and the second power supply terminal, the drain of the first transistor is connected to the drain of the second transistor and the anode of the OLED, the gate of the second transistor is connected to the second control terminal, the source of the third transistor is connected to another terminal of the first capacitor and the drain of the fourth transistor, and the gate thereof is connected to the first control terminal, and the gate of the fourth transistor is connected to the scanning control terminal, and the source thereof is connected to the first power supply terminal.

3. The pixel circuit array according to claim 2, wherein each of the first transistor, the second transistor, the third transistor and the fourth transistor is a thin film transistor (TFT).

4. An organic light emitting diode (OLED) panel, comprising the pixel circuit array according to claim 1.

5. An organic light emitting diode (OLED) panel driving method adapted for the OLED panel according to claim 4, wherein, of the pixel driving circuit, the precharge circuit includes a fourth transistor and a first capacitor; the compensation circuit includes a second transistor; the holding circuit includes a third transistor; the driving circuit includes a first transistor; and a light emitting circuit includes an organic light emitting diode (OLED), the method comprising steps of:

outputting, by the scanning line, an active signal through the scanning control terminal so as to turn on the fourth transistor, and outputting an inactive signal by the first control terminal and the second control terminal so as to turn off the second transistor and the third transistor;

inputting an active signal to the gate of the first transistor so as to turn on the first transistor; and transmitting a first level signal outputted from the second power supply terminal to the anode of the OLED through the first transistor.

6. The method according to claim 5, prior to the step of transmitting a first level signal outputted from the second power supply terminal to the anode of the OLED through the first transistor, further comprising:

outputting the first level signal from both of the first power supply terminal and the second power supply terminal and outputting a second level signal from the third power supply terminal.

7. The method according to claim 6, further comprising outputting the active signal from the second control terminal so as to turn on the second transistor, the drain voltage of the first transistor being equal to the gate voltage thereof.

8. The method according to claim 7, prior to turning on the second transistor, further comprising changing the output voltage of the first power supply terminal into a data voltage of a current frame.

9. The method according to claim 7, wherein the voltages of the drain and the gate of the first transistor are both equal to the output voltage of the second power supply terminal.

10. The method according to claim 8, after outputting the active signal from the second control terminal so as to turn on the second transistor, the drain voltage of the first transistor being equal to the gate voltage thereof, further comprising:

outputting a direct-current reference voltage from the second power supply terminal.

11. The method according to claim 6, further comprising steps of:

outputting the active signal to the gate of the first transistor so as to turn on the first transistor and outputting the active signal from first control terminal so as to turn on the third transistor; and outputting the inactive signal from the second control terminal and the scanning control terminal so as to turn off the second transistor and the fourth transistor, and delivering a data current to the OLED via the drain of the first transistor.

12. The method according to claim 11, prior to outputting the active signal to the gate of the first transistor so as to turn on the first transistor and outputting the active signal from first control terminal so as to turn on the third transistor, further comprising:

outputting the second level signal from the second power supply terminal and outputting the first level signal from the third power supply terminal.

* * * * *